US009864387B2

(12) United States Patent
Ogura et al.

(10) Patent No.: US 9,864,387 B2
(45) Date of Patent: Jan. 9, 2018

(54) VOLTAGE REGULATOR

(71) Applicant: SII Semiconductor Corporation, Chiba-shi, Chiba (JP)

(72) Inventors: Yasuhiko Ogura, Chiba (JP); Kaoru Sakaguchi, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 15/215,719

(22) Filed: Jul. 21, 2016

(65) Prior Publication Data

US 2017/0023960 A1 Jan. 26, 2017

(30) Foreign Application Priority Data

Jul. 24, 2015 (JP) ..... 2015-146796

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)

(58) Field of Classification Search
None
See application file for complete search history.

(56) References Cited

U.S. PATENT DOCUMENTS 5,689,309 A * 11/1997 Nayebi ..... H04N 5/265 348/584
8,319,553 B1 * 11/2012 Ivanov ..... H03F 1/223 330/253
2002/0067208 A1 * 6/2002 Ugajin ..... H03F 3/45179 330/258
2003/0132798 A1 * 7/2003 Yoshida ..... H03H 11/0422 327/552
2011/0074503 A1 * 3/2011 Tsuzaki ..... H03F 3/45475 330/124 R
2015/0022268 A1 * 1/2015 Kao ..... H03F 3/45071 330/259
2015/0229278 A1 * 8/2015 Ivanov ..... H03F 1/26 330/9

FOREIGN PATENT DOCUMENTS

JP 2004-030064 A 1/2004

* cited by examiner

*Primary Examiner* — Jeffrey Gblende
(74) *Attorney, Agent, or Firm* — Brinks Gilson & Lione

(57) ABSTRACT

Provided is a voltage regulator which is not affected by a variation in output impedance of a reference voltage circuit, that is, which is configured to output voltage with a small change due to temperature. Two reference voltages respectively having positive and negative temperature coefficients are added together through transconductance amplifiers having large input impedances, respectively, and the resultant is amplified.

3 Claims, 3 Drawing Sheets

VOLTAGE REGULATOR

RELATED APPLICATIONS

This application claims priority under 35 U.S.C. §119 to Japanese Patent Application No. 2015-146796 filed on Jul. 24, 2015, the entire content of which is hereby incorporated by reference.

BACKGROUND OF THE INVENTION

1. Field of the Invention

The present invention relates to a voltage regulator configured to output voltage independent of ambient temperature.

2. Description of the Related Art

FIG. 4 is an illustration of a related-art reference voltage circuit configured to output voltage with a small change due to temperature. A related-art reference voltage circuit 10 is configured to average, with an averaging circuit 13, an output voltage Vref1 of a first reference voltage circuit 11 having a positive temperature coefficient, and an output voltage Vref2 of a second reference voltage circuit 12 having a negative temperature coefficient, and to adjust the averaged voltage to a predetermined voltage with a non-inverting amplifier circuit 14, thereby generating a reference voltage Vref with a small change due to temperature (for example, see Japanese Patent Application Laid-open No. 2004-30064).

A voltage VA of an output terminal (node A) of the averaging circuit 13 of the reference voltage circuit 10 is expressed by the following expression when a resistance value of each resistor of the averaging circuit 13 is represented by R, an output impedance of the first reference voltage circuit 11 is represented by Ro1, and an output impedance of the second reference voltage circuit 12 is represented by Ro2.

$$VA=\{V\mathrm{ref}1(R+R\mathrm{o}2)+V\mathrm{ref}2(R+R\mathrm{o}1)\}/(2R+R\mathrm{o}1+R\mathrm{o}2)$$

Here, the output voltage VA of the averaging circuit 13 has an error when the resistance value R is not such a large value that allows the output impedances Ro1 and Ro2 to be ignored, and when the output impedance Ro1 and the output impedance Ro2 differ from each other.

Further, the area occupied by the averaging circuit 13 is increased when the resistance value R is set to a large value.

SUMMARY OF THE INVENTION

A voltage regulator according to one embodiment of the present invention has the following configuration in order to solve the problems described above.

Provided is a voltage regulator, including:

a first reference voltage circuit configured to output a first reference voltage having a positive temperature coefficient;

a second reference voltage circuit configured to output a second reference voltage having a negative temperature coefficient;

a feedback circuit configured to divide an output voltage output from an output transistor to generate a feedback voltage, and to output the feedback voltage; and an error amplifier circuit configured to amplify an error between the feedback voltage and the first reference voltage and an error between the feedback voltage and the second reference voltage, and to output the amplified errors, thereby controlling a gate of the output transistor, the error amplifier circuit including:

a first transconductance amplifier configured to output a first output current and a second output current that are based on a voltage difference between the first reference voltage and the feedback voltage;

a second transconductance amplifier configured to output a third output current and a fourth output current that are based on a voltage difference between the second reference voltage and the feedback voltage;

an addition stage configured to output a first added current obtained by adding the first output current and the third output current together, and a second added current obtained by adding the second output current and the fourth output current together; and an amplifier stage configured to convert the first added current and the second added current into voltages, and to amplify a difference between the voltages.

According to the voltage regulator of the present invention, the two reference voltages, which are the outputs respectively having the positive and negative temperature coefficients, are added together through the transconductance amplifiers having large input impedances, respectively. A voltage regulator can therefore be achieved which is not affected by a variation in output impedance of the reference voltage circuits, that is, which is configured to output voltage with a small change due to temperature.

DETAILED DESCRIPTION OF THE PREFERRED EMBODIMENTS

Figure 1:
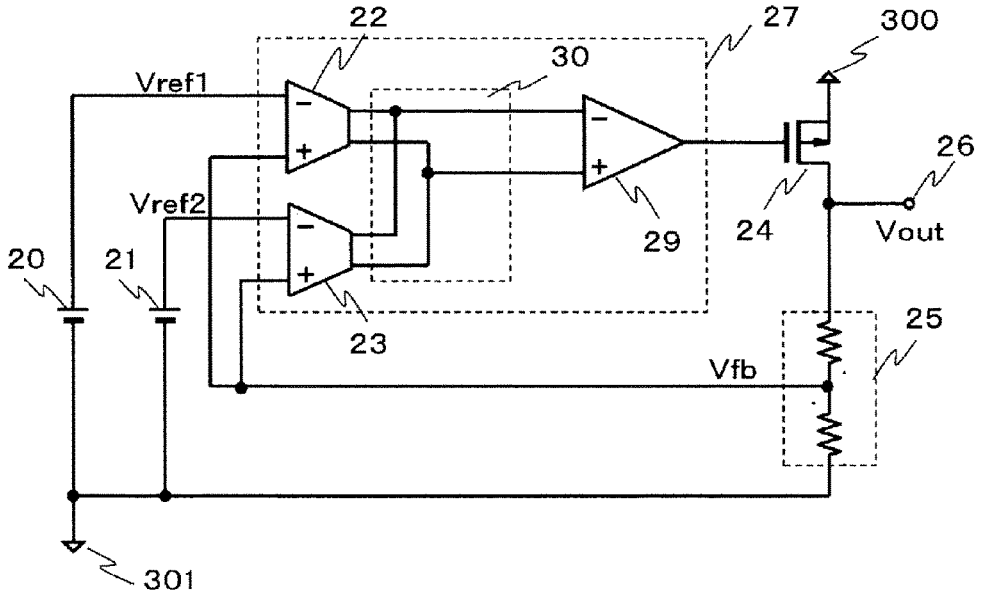
FIG. 1 is a circuit diagram for illustrating a voltage regulator according to an embodiment of the present invention.

FIG. 1 is a block diagram for illustrating a voltage regulator according to an embodiment of the present invention.

The voltage regulator of this embodiment includes: a first reference voltage circuit 20; a second reference voltage circuit 21; an error amplifier circuit 27 including a first transconductance amplifier 22, a second transconductance amplifier 23, an addition stage 30, and an amplifier stage 29; a feedback circuit 25; and a MOSFET 24.

The first transconductance amplifier 22 has a non-inverting input terminal (hereinafter referred to as "positive terminal") connected to an output terminal of the feedback circuit 25, and an inverting input terminal (hereinafter referred to as "negative terminal") connected to the first reference voltage circuit 20. The second transconductance amplifier 23 has a positive terminal connected to the output terminal of the feedback circuit 25, and a negative terminal connected to the second reference voltage circuit 21. The amplifier stage 29 has an input terminal to which an output terminal of the first transconductance amplifier 22 and an output terminal of the second transconductance amplifier 23 are connected through the addition stage 30, and an output terminal connected to a gate of the MOSFET 24. The MOSFET 24 has a source connected to a power supply terminal 300, and a drain connected to an output terminal 26 of the voltage regulator. The feedback circuit 25 is connected between the output terminal 26 of the voltage regulator and a GND 301.

The first reference voltage circuit 20 is configured to output a reference voltage Vref1 having a negative temperature coefficient. The second reference voltage circuit 21 is configured to output a reference voltage Vref2 having a positive temperature coefficient. The feedback circuit 25 is configured to divide an output voltage Vout generated at the output terminal 26 of the voltage regulator, and to output the divided voltage to the output terminal as a feedback voltage Vfb. The error amplifier circuit 27 is configured to amplify errors between the feedback voltage Vfb and the reference voltage Vref1, and between the feedback voltage Vfb and the reference voltage Vref2, and to output the amplified errors as an output voltage, thereby controlling the gate of the MOSFET 24 with the output voltage.

Figure 2:
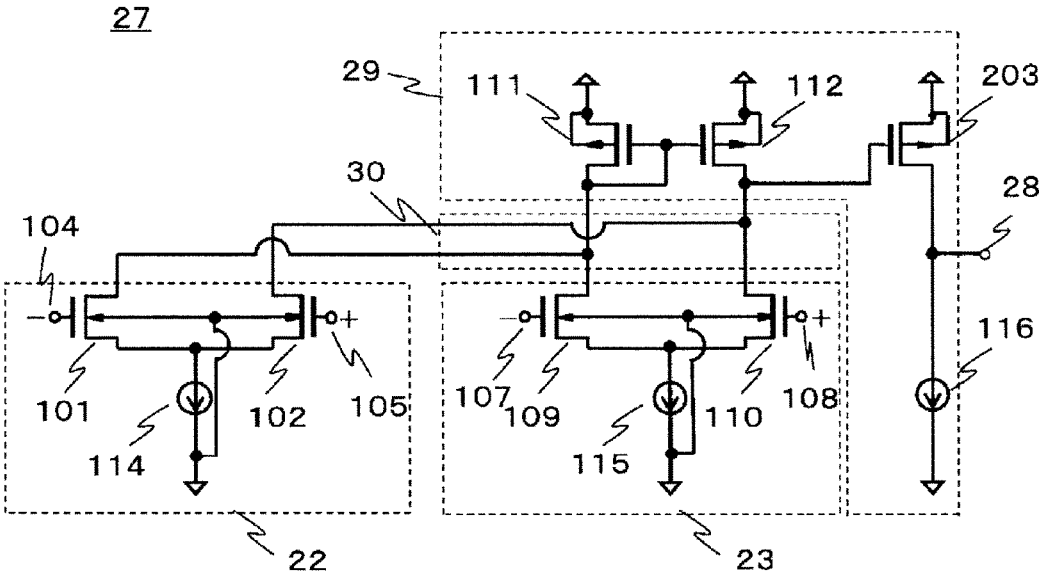
FIG. 2 is a circuit diagram for illustrating an error amplifier circuit of the voltage regulator of the embodiment.

FIG. 2 is a circuit diagram for illustrating the error amplifier circuit of the voltage regulator of this embodiment.

The error amplifier circuit 27 includes the first transconductance amplifier 22, the second transconductance amplifier 23, the addition stage 30, and the amplifier stage 29. The first transconductance amplifier 22 includes N-channel MOSFETs 101 and 102 and a current source 114. The second transconductance amplifier 23 includes N-channel MOSFETs 109 and 110 and a current source 115. The amplifier stage 29 includes P-channel MOSFETs 111, 112, and 203, and a current source 116.

The first transconductance amplifier 22 has an input terminal 104 connected to the first reference voltage circuit 20, and an input terminal 105 connected to the output terminal of the feedback circuit 25. The second transconductance amplifier 23 has an input terminal 107 connected to the second reference voltage circuit 21, and an input terminal 108 connected to the output terminal of the feedback circuit 25. Output terminals of the first transconductance amplifier 22 and the second transconductance amplifier 23 are connected to each other in the addition stage 30. The addition stage 30 has an output terminal connected to an input terminal of the amplifier stage 29.

The addition stage 30 includes, in a preceding stage thereof, the first transconductance amplifier 22 and the second transconductance amplifier 23. The gate of the MOSFET serves as an input terminal of the addition stage 30, and hence an input impedance of the addition stage 30 is high when seen from the first reference voltage circuit 20 and the second reference voltage circuit 21. Thus, the influence of output impedances of the first reference voltage circuit 20 and the second reference voltage circuit 21 on the addition stage 30 can be ignored.

The first transconductance amplifier 22 is configured to output output currents Io1 and Io2 from a voltage corresponding to a difference between the reference voltage Vref1 and the feedback voltage Vfb.

The second transconductance amplifier 23 is configured to output output currents Io3 and Io4 from a voltage corresponding to a difference between the reference voltage Vref2 and the feedback voltage Vfb.

The addition stage 30 is configured to add the output current Io1 and the output current Io3 together, thereby outputting an added current Ia1, and to add the output current Io2 and the output current Io4 together, thereby outputting an added current Ia2. The amplifier stage 29 is configured to convert the added currents Ia1 and Ia2 into voltages, to amplify a difference therebetween, and to output, as an output voltage, the difference to an output terminal 28 of the error amplifier circuit 27. This output voltage is input to the gate of the MOSFET 24 in order to control the output voltage Vout of the voltage regulator to a desired value with a small change due to temperature.

As described above, according to the voltage regulator of this embodiment, the two reference voltages, which are the outputs respectively having the positive and negative temperature coefficients, are added together through the transconductance amplifiers having large input impedances, respectively. A voltage regulator can therefore be achieved which is not affected by a variation in output impedance of the reference voltage circuits, that is, which is configured to output voltage with a small change due to temperature.

Figure 3:
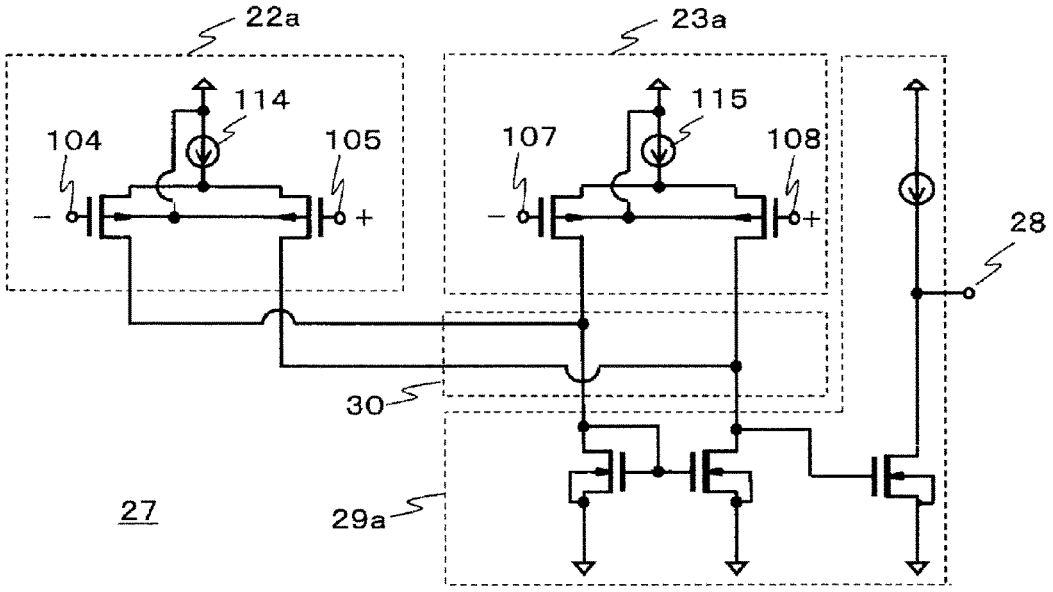
FIG. 3 is a circuit diagram for illustrating another example of the error amplifier circuit of the voltage regulator of the embodiment.
Figure 4:
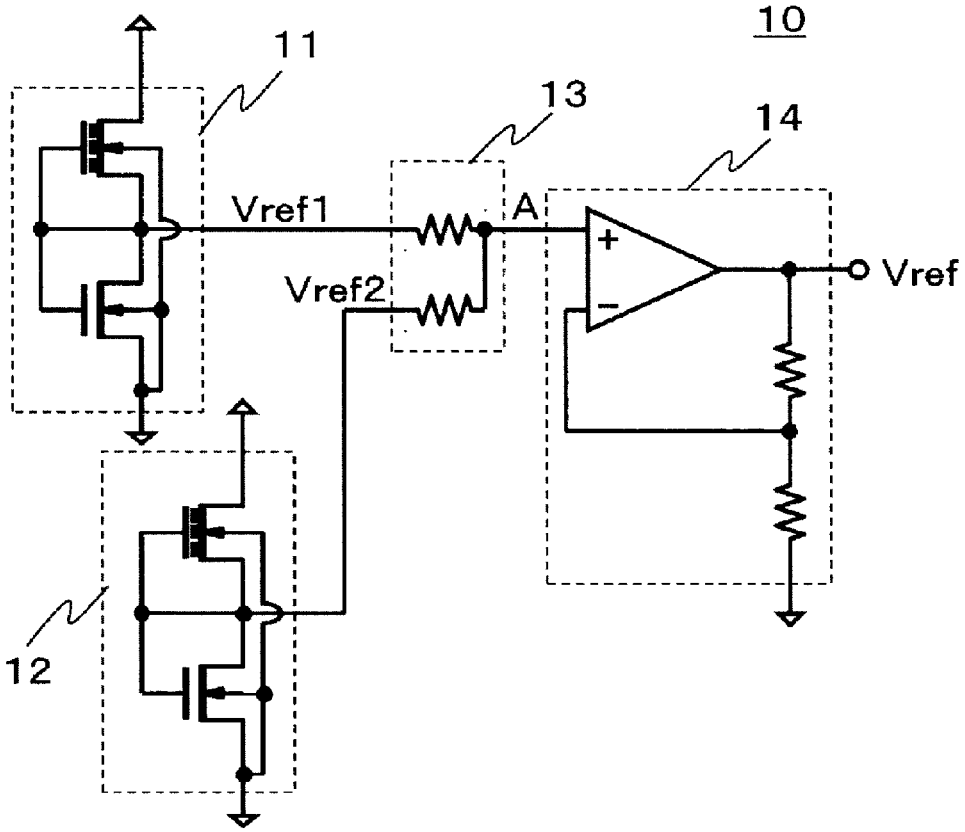
FIG. 4 PRIOR ART
FIG. 4 is a circuit diagram for illustrating a related-art reference voltage circuit.

FIG. 3 is a circuit diagram for illustrating another example of the error amplifier circuit of the voltage regulator of this embodiment.

The error amplifier circuit 27 includes a first transconductance amplifier 22*a*, a second transconductance amplifier 23*a*, the addition stage 30, and an amplifier stage 29*a*. The first transconductance amplifier 22*a* and the second transconductance amplifier 23*a* are formed of input pairs of P-channel MOSFETs. The amplifier stage 29*a* is formed of N-channel MOSFETs in consideration of the configurations of the transconductance amplifiers.

A similar effect is provided by the error amplifier circuit 27 including, as described above, the first transconductance amplifier 22*a*, the second transconductance amplifier 23*a*, and the amplifier stage 29*a*.

Further, the error amplifier circuit 27 may have a configuration formed by appropriately selecting combinations of the circuits of FIG. 1 and FIG. 2. For example, the error amplifier circuit 27 may include the first transconductance amplifier 22*a*, the second transconductance amplifier 23, the addition stage 30, and the amplifier stage 29.

The feedback circuit 25 may be configured to output a first feedback voltage Vfb and a second feedback voltage Vfb. The first feedback voltage Vfb is input to the first transconductance amplifier 22, and the second feedback voltage Vfb is input to the second transconductance amplifier 23. With this configuration, a variation in reference voltage of the first reference voltage circuit 20 and the second reference voltage circuit 21 can be compensated for by the feedback circuit 25.

Further, the two reference voltages are added together through the two transconductance amplifiers, respectively, and hence through adjustment of currents that the current sources 114 and 115 of the respective transconductance amplifiers cause to flow, it is possible to adjust how much the temperature coefficients of the reference voltage circuits 20 and 21 affect the output voltage Vout of the voltage regulator.

As described above, according to the voltage regulator of this embodiment, the two reference voltages, which are the outputs respectively having the positive and negative temperature coefficients, are added together through the transconductance amplifiers having large input impedances, respectively. A voltage regulator can therefore be achieved which is not affected by a variation in output impedance of the reference voltage circuits, that is, which is configured to output voltage with a small change due to temperature.

What is claimed is:

1. A voltage regulator, comprising:

a first reference voltage circuit configured to output a first reference voltage having a positive temperature coefficient;

a second reference voltage circuit configured to output a second reference voltage having a negative temperature coefficient;

a feedback circuit configured to divide an output voltage output from an output transistor to generate a feedback voltage, and to output the feedback voltage; and an error amplifier circuit configured to amplify an error between the feedback voltage and the first reference voltage and an error between the feedback voltage and the second reference voltage, and to output the amplified errors, thereby controlling a gate of the output transistor, the error amplifier circuit comprising:

a first transconductance amplifier configured to output a first output current and a second output current that are based on a voltage difference between the first reference voltage and the feedback voltage;

a second transconductance amplifier configured to output a third output current and a fourth output current that are based on a voltage difference between the second reference voltage and the feedback voltage;

an addition stage configured to output a first added current obtained by adding the first output current and the third output current together, and a second added current obtained by adding the second output current and the fourth output current together; and an amplifier stage configured to convert the first added current and the second added current into voltages, and to amplify a difference between the voltages.

2. A voltage regulator according to claim 1, wherein one of a current that a current source of the first transconductance amplifier causes to flow and a current that a current source of the second transconductance amplifier causes to flow is adjusted, to thereby adjust how much one of the positive temperature coefficient of the first reference voltage circuit and the negative temperature coefficient of the second reference voltage circuit affects the output voltage of the voltage regulator.

3. A voltage regulator according to claim 1, wherein the feedback circuit is configured to output a first feedback voltage and a second feedback voltage, wherein the first feedback voltage is input to the first transconductance amplifier, and wherein the second feedback voltage is input to the second transconductance amplifier.

* * * * *